US006769569B1

(12) United States Patent
Yu

(10) Patent No.: US 6,769,569 B1
(45) Date of Patent: Aug. 3, 2004

(54) VENDING MACHINE WITH SECURITY DEVICE

(75) Inventor: Cheng-Kang Yu, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 34 days.

(21) Appl. No.: 10/346,130

(22) Filed: Jan. 17, 2003

(51) Int. Cl.[7] ..... A47F 1/04
(52) U.S. Cl. ..... 221/154; 221/197
(58) Field of Search ..... 221/154, 197, 221/247, 151, 281, 282, 163, 162

(56) References Cited

U.S. PATENT DOCUMENTS 4,789,079 A * 12/1988 Kobayashi et al. ..... 221/232

* cited by examiner

*Primary Examiner*—Kenneth Noland
(74) *Attorney, Agent, or Firm*—Bacon & Thomas PLLC

(57) ABSTRACT

A vending machine with security device is disclosed. The security device is fitted onto a dispensing device, wherein the security device is positioned in between the dispensing device and a driving device of the vending machine. The security device together with the dispensing device support the dispensing lid and rotate upwards when the card is being dispensed by the driving device of the vending machine, and when the card passes through the dispensing lid of the security device and being dispensed out by the dispensing device of the vending machine, the dispensing lid of the security device will automatically rotate downwards for closing the slot.

9 Claims, 5 Drawing Sheets

VENDING MACHINE WITH SECURITY DEVICE

BACKGROUND OF THE INVENTION

1. The Field of the Invention

The present invention generally relates to a vending machine, and more particularly relates to a vending machine with security device comprising a security device disposed in between a dispensing device and a driving device of the vending machine for effectively preventing the cards therein from being stolen.

2. Description of the Related Art

With the rapid advancement and development in the automation technology, the automatic vending machines, such as, ticketing machine or lottery ticketing machine, are installed in many public places for satisfying the needs of the consumers to provide convenience and prompt service. The service provided by these machines is for not only reducing the labor cost substantially, but also more acceptable to the consumers because the convenience. However, the general automatic vending machines will be under the supervision only during the routine manual storage check-up or maintenance, and when they are not under the supervision by the authorized personnel, the cards or bills therein can be stolen by using several methods, for example, by using a card stuck with a double-sided adhesive tape, which is mostly to insert into the vending machine for sticking out the cards from inside the vending machine. For preventing such stealing activity, some of the manufacturers of the vending machines enlarged the vertical depth of the slot channel in order to prevent the cards therein being stuck by the inserted card with the double-sided adhesive tape. However, such a scheme still has defects, in that, the cards inside the vending machine can still be stolen by inserting the card with double-sided adhesive tape deeper inside the vending machine with an aid of a string, a steel wire or some other longer flat objects, adhered at a distal end of the card with double-sided adhesive tape. Some others have proposed few other methods for preventing cards from being stolen, such as, to set a lid on the slot channel where the cards are dispended, the lid will be opened only when the card is demanded by a formal purchase and closed right after serving. Nevertheless, this design can not be effective, because a metallic plate or other similar object can be inserted into the slot at the very moment while the lid opens to prevent the lid from closing, and then, the cards can be stuck out by using the same method as mentioned above.

Accordingly it highly desirable to further improve the conventional design to overcome the above defects.

SUMMARY OF THE INVENTION

Accordingly, in the view of the foregoing, the present inventor makes a detailed study of related art to evaluate and consider, and uses years of accumulated experience in this field, and through several experiments, to create a new security device for vending machine of the present invention. The present invention provides an innovated cost effective vending machine with a security system to effectively prevent the card inside the vending machine from being stolen.

In accordance with the above objects and other advantages of the present invention as broadly embodied and described herein, a vending machine with security device is provided. The vending machine with security device comprises a security device fitted onto a dispensing device, wherein the security device is positioned in between the dispensing device and a driving device of the vending machine. The security device together with the dispensing device support the dispensing lid and rotates the dispensing lid upwards while the card is being dispensed by the driving device of the vending machine. When the card passes through the dispensing lid of the security device and being dispensed out by the dispensing device of the vending machine, the dispensing lid of the security device will automatically rotate downwards for closing the slot.

According to another aspect of the present invention, a positioning plate is provided at the dispensing device of the vending machine, a sensor is installed on the positioning plate, and a bent sensor plate is installed extending on the flange of the lid of the security device to detect the status of the dispensing lid of the security device.

BRIEF DESCRIPTION OF THE DRAWING

For a more complete understanding of the present invention, reference will now be made to the following detailed description of preferred embodiments taken in conjunction with the accompanying drawings, in which.

DETAILED DESCRIPTION OF PREFERRED EMBODIMENTS

Figure 1:
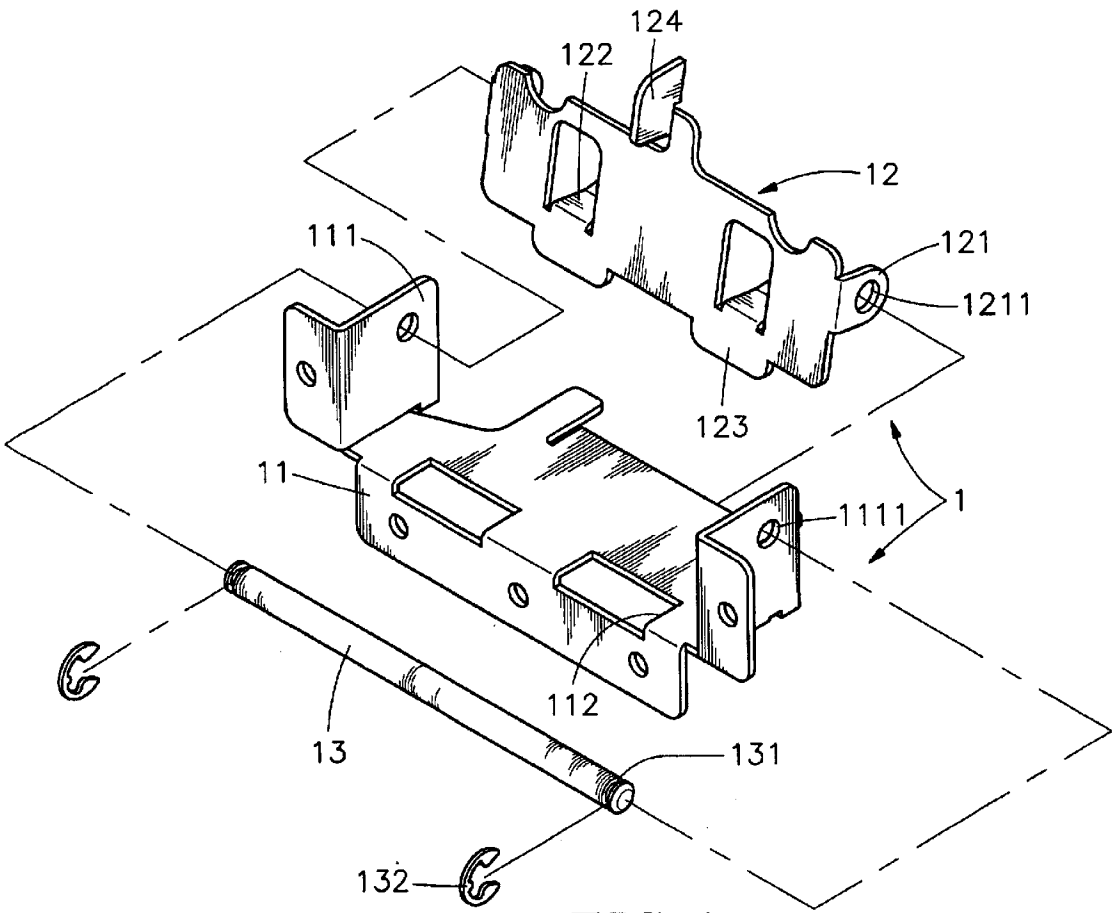
FIG. 1 is an exploded view of a security device of the present invention.
Figure 2:
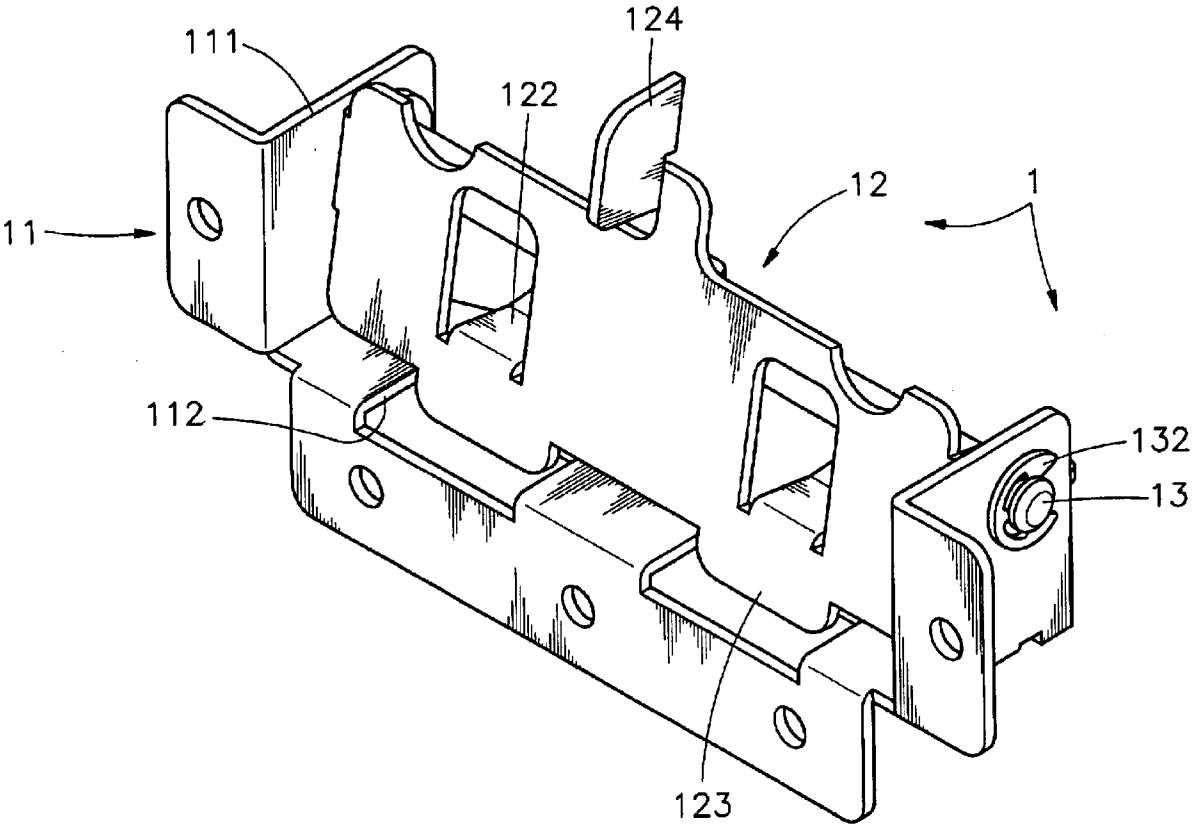
FIG. 2 is an elevational view of a structure of the security device of the present invention.
Figure 3:
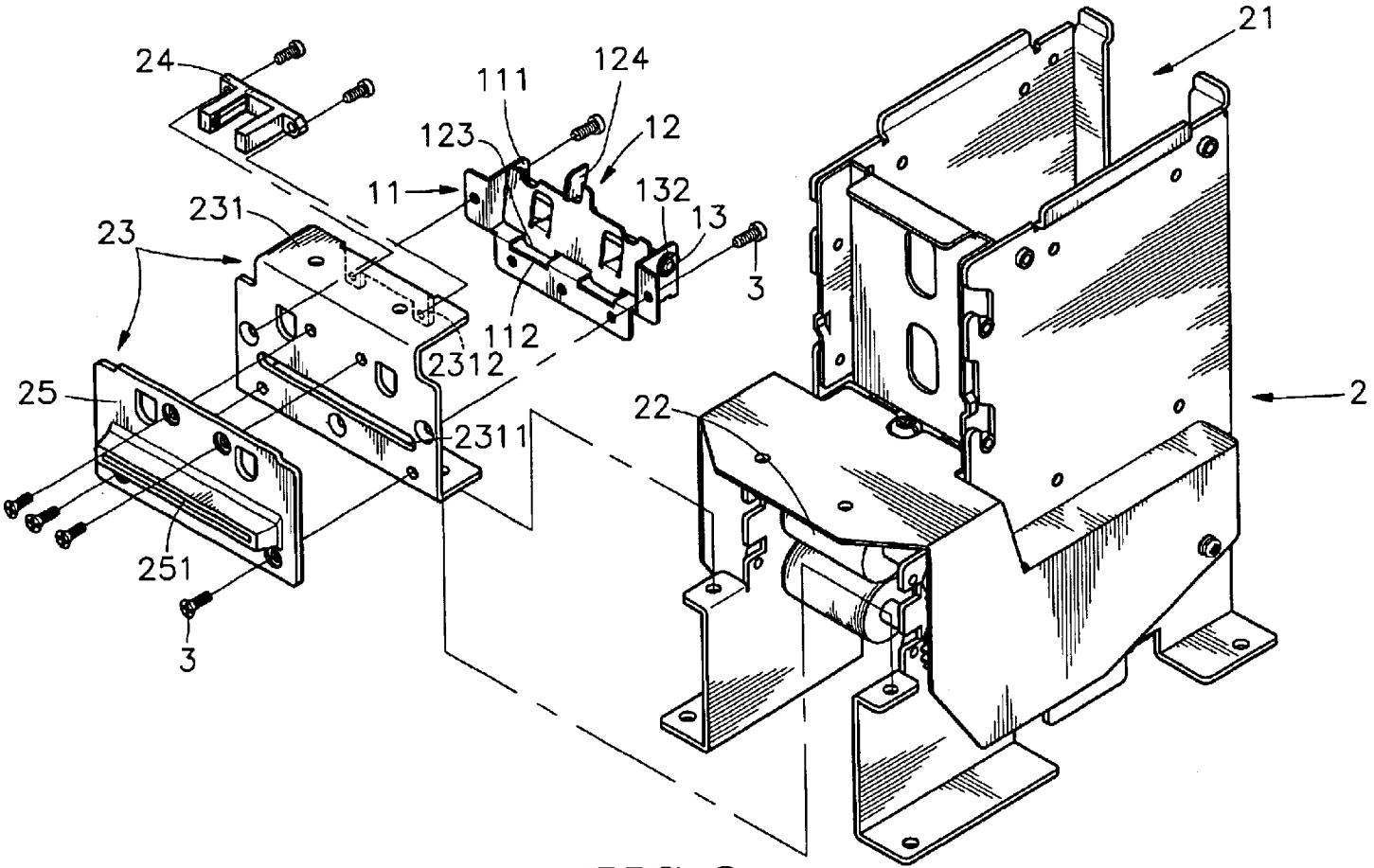
FIG. 3 is an exploded view of the vending machine with security device of the present invention.
Figure 4:
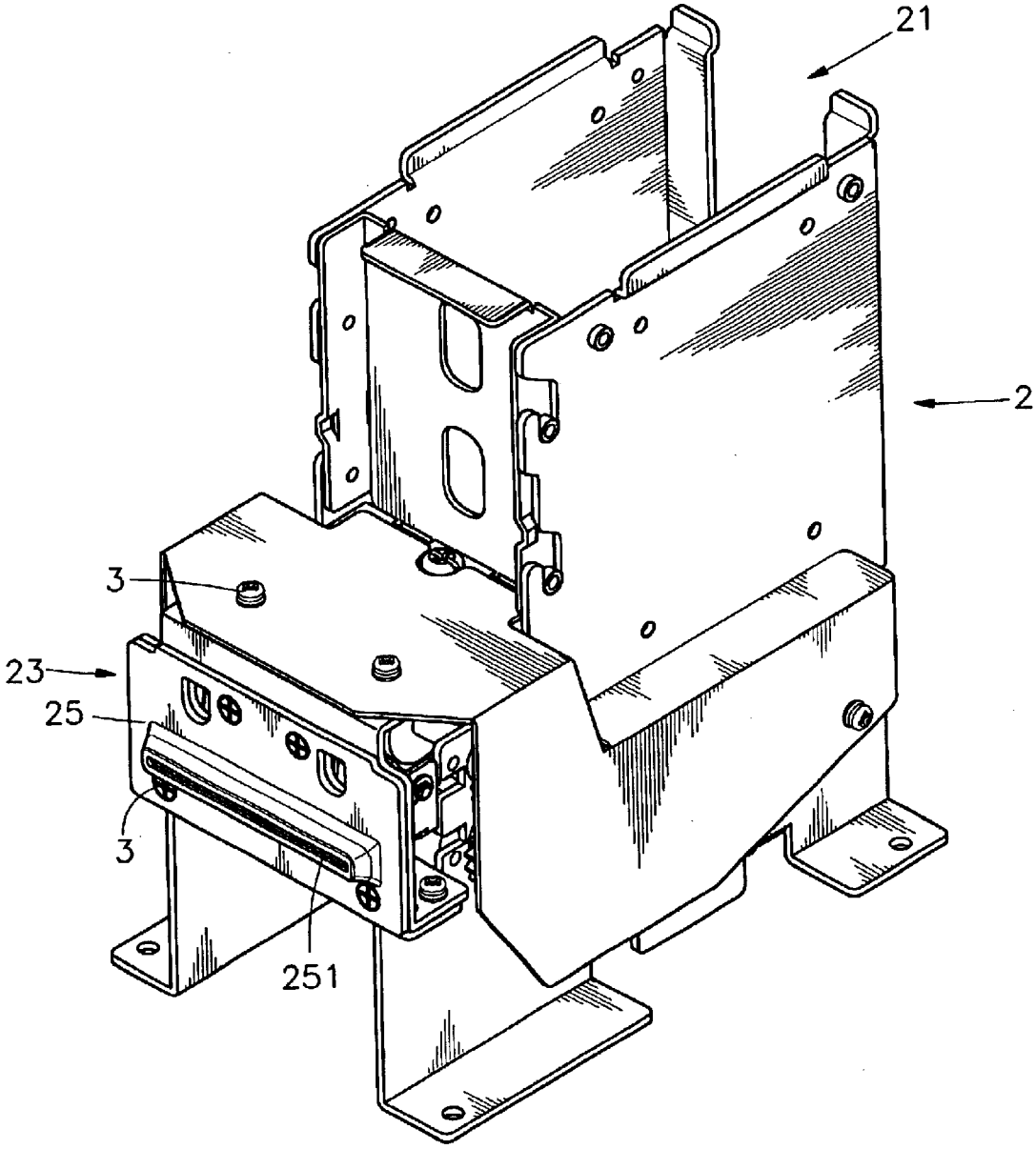
FIG. 4 is an elevational view of the vending machine with security device of the present invention.

Reference will be made in detail to the preferred embodiments of the invention, examples of which are illustrated in the accompanying drawings. Wherever possible, the same reference numbers are used in the drawings and the description to refer to the same or like parts.

Referring to the FIGS. 1~4, shows a security device 1 and a vending machine 2 of the present invention. The security device 1 comprises a chassis 11 and a dispensing lid 12. The two sides of the chassis 11 are bent into a shape of wing pads 111, wherein each side of the chassis 11 has an aperture 1111. The bottom portion of the chassis 11 comprises through grooves 112 The two sides of the dispensing lid 12 are also bent into a shape of wing pads 121, wherein each side of the dispensing lid 12 has an aperture 1211, and two biasing plates 122 which are bent backwards extend from a frontal portion of the dispensing lid 12. A plurality of supporting plates 123 extend from a bottom flange of the dispensing lid 12, and a bent extended sensor plate 124 is formed at a top flange of the dispensing lid 12. The dispensing lid 12 is installed in between the two wing pads 111 of the chassis 11 and the supporting plates 123 of the lid 12, wherein the supporting plates 123 can be received into the through grooves 112 of the chassis 11. A roller 13 penetrates through the apertures 1111 of the chassis 11 and the apertures 1211 of the dispensing lid 12. A plurality of buckling ring plates 132 are inserted into the respective buckling grooves 131 which are formed on two sides of the roller 13, so that this arrangement would allow the lid 12 to rotate axially together with the roller 13.

The vending machine 2 comprises a space 21 and a driving device 22. A dispensing device 23 positioned at a frontal portion of the driving device 22. The dispensing device 23 comprises a positioning plate 231 having a through groove 2311 formed on its surface and a bent positioning plate 2312 formed on a top surface. A sensor 24 is positioned on the positioning plate 2312. Furthermore, the surface of the dispensing device 23 can provide a means to position a panel 25, wherein the panel 25 comprises a slot 251.

According to an aspect of the present invention, the chassis 11 of the security device 1 is fixed by a plurality of fixing elements 3 to the rear side of the positioning plate 231 of the dispensing device 23, then the bent sensor plate 124 that extend at the top flange of the dispensing lid 12 can fit into the sensor 24 of the dispensing device 23. The dispensing device 23 is positioned in front of the driving device 22 of the vending machine 2 by using a plurality of the fixing elements 3 in order to make the dispensing lid 12 of the security device 1 position between the dispensing device 23 and the driving device 22 of the vending machine 2. Thus the above arrangement allows closing the through groove 2311 of the dispensing device 23.

Figure 7:
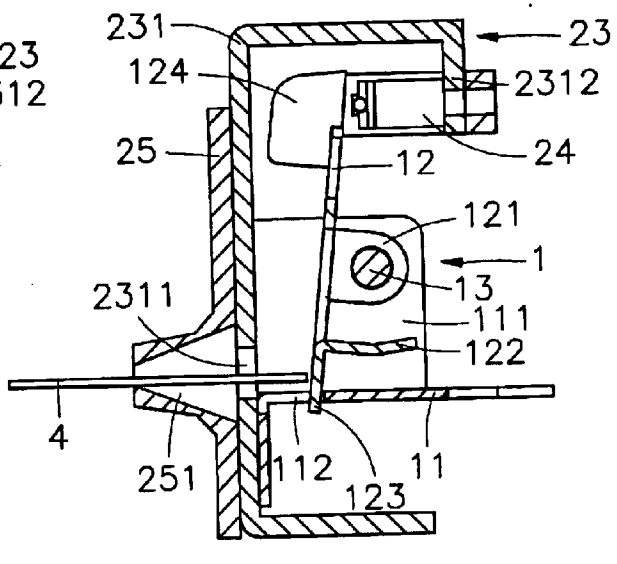
FIG. 7 is a sectional view after the motion of the dispensing lid of the security device of the present invention.
Figure 6:
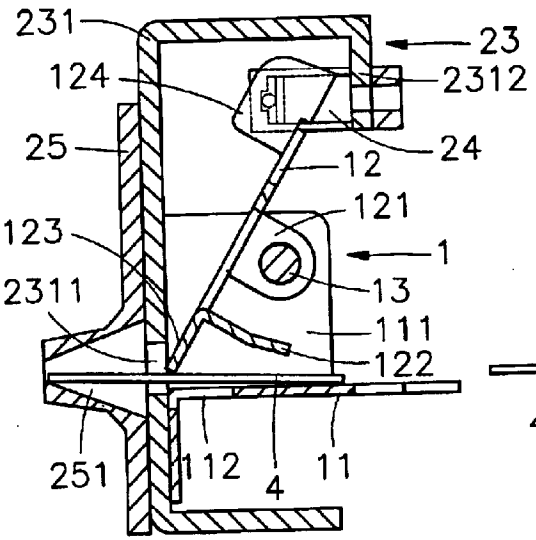
FIG. 6 is a sectional view during the motion of the dispensing lid of the security device of the present invention.
Figure 5:
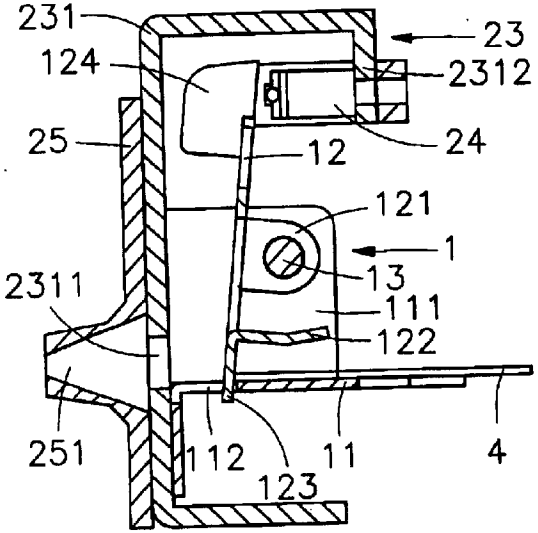
FIG. 5 is a sectional view before the motion of the dispensing lid of the security device of the present invention.

Further referring to FIGS. 5~7, the actual functioning of the vending machine with the security device of the present invention is described as follows. As shown in the above figures, when the driving device 22 of the vending machine 2 is activated, the card 4 stored within the space 21 is moved towards the dispensing device 23, the frontal flange of the card 4 is initially against the dispensing lid 12 of the security device 1, the dispensing lid 12 rotates axially upwards along with the roller 13 for making a slit space to allow the card 4 to pass through. When the card 4 enters into the through groove 2311 of the positioning plate 231 of the dispensing device 23 and exits out from the slot 251 of the panel 25, the dispensing lid 12 rotates downwards axially together with the roller 13 under the gravitational force of the plurality of biasing plates 122, and the supporting plate 123 which are positioned at the bottom flange of the dispensing lid 12 further supports within the through groove 112 at the bottom portion of the chassis 11 for positioning.

Furthermore, when the above dispensing lid 12 rotates upwards along with the roller 13 to provide a slit space for the card 4 to pass through, the bent sensor plate 124 extending at the top flange of the dispensing lid 12 blocks the sensor 24 of the dispensing device 23, as a result, the sensor 24 generates an output signal for a card 4 to notify the vending machine 2. However, because to the size of the cards 4 stored inside the vending machine 2 is same, therefore the time taken for each card 4 dispensed by the dispensing lid 12 of the security device 1 is maintained same, as well as the time for the bent sensor plate 124 of the dispensing slid 12 to support on the sensor 24. Therefore, if any person intents to use a metallic plate, wire or other material to interrupt the dispensing lid 12 while closing to steal the cards therein, such action will cause an increase in time for the bent sensor plate 124 of the dispensing lid 12 to block the sensor 24, in response, the sensor 24 will generate a signal to make the vending machine 2 activate an alarm system preset therein.

According to another aspect of the present invention, when the card 4 exits out from the slot 251 of the panel 25, the above dispensing lid 12 rotates downwards by the gravitational force of the biasing plates 122 and the supporting plates 123 positioned at the bottom flange of the dispensing lid 12 supports on the wall of the through groove 112 of the chassis 11 for closing position, thus prevents the cards 4 from being inappropriately snatched out by sticking the metallic plate, wire or other material, with the adhesive tape into the slot 251 of the panel 25.

It is to be understood that the space 21 of the vending machine 2 is not only for storing cards 4 as described above, but can also be designed to store other objects, such as lottery tickets or money bills may be stored to practice the present invention.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A vending machine with security device for storing and dispensing cards, comprising:

a dispensing device comprising a security device, wherein said security device comprises a chassis positioned at a rear portion of said dispensing device, and a dispensing lid; and a driving device, wherein the dispensing lid is positioned between said dispensing device and the driving device, and wherein when the driving device is activated, said dispensing lid is rotated upwards by the driving device allowing a card stored in the vending to pass by the dispensing lid of the security device and gets dispensed out of a slot, and said dispensing lid of said security device rotates automatically downwards for closing the slot.

2. The vending machine with security device according to claim 1, wherein said chassis comprises a shape of a bent wing pads, wherein at each of two sides thereof comprise an aperture, and wherein said dispensing lid also comprises a shape of a bent wing pads, wherein at each of two sides thereof comprise an aperture, and wherein said apertures of said chassis and dispensing lid are provided for penetrating through a roller to provide a means to said dispensing lid to rotate axially.

3. The vending machine with security device according to claim 1, wherein said chassis comprises a through groove at a bottom portion, said dispensing lid comprises a supporting plate extending on a bottom flange, and said supporting plate of said dispensing lid is positioned within said through groove of said chassis.

4. The vending machine with security device according to claim 1, wherein said dispensing lid comprises a plurality of biasing plates that are bent backwards and positioned extending from a surface of the dispensing lid.

5. The vending machine with security device according to claim 1, wherein said dispensing device of said vending machine further comprises:

a positioning plate having a through groove on a surface thereof and a positioning plate bent on a top surface;

a sensor positioned on said positioning plate; and a bent sensor plate extending from a top flange of said dispensing lid of said security device, said sensor plate is positioned within said sensor to detect the status of said dispensing lid of said security device.

6. The vending machine with security device according to claim 1, wherein said dispensing device of said vending machine comprises a panel with a slot positioned on a surface thereof.

7. The vending machine with security device according to claim 1, wherein said vending machine comprises a space for storing a plurality of cards.

8. The vending machine with security device according to claim 1, wherein said vending machine comprises a space for storing money bills.

9. The vending machine with security device according to claim 1, wherein said vending machine comprises a space for storing lottery tickets.

* * * * *